US009232603B2

(12) United States Patent
Archenhold et al.

(10) Patent No.: US 9,232,603 B2
(45) Date of Patent: Jan. 5, 2016

(54) LIGHTING CONTROL SYSTEMS

(75) Inventors: Geoffrey Howard Gillet Archenhold, Sutton Coldfield (GB); Keith Anderson, Pelsall (GB)

(73) Assignee: Landy Vent UK Limited, Studley, Warwickshire (GB)

( * ) Notice: Subject to any disclaimer, the term of this patent is extended or adjusted under 35 U.S.C. 154(b) by 539 days.

(21) Appl. No.: 12/738,750

(22) PCT Filed: Apr. 22, 2008

(86) PCT No.: PCT/GB2008/001411

§ 371 (c)(1),
(2), (4) Date: Jun. 17, 2010

(87) PCT Pub. No.: WO2009/050418

PCT Pub. Date: Apr. 23, 2009

(65) Prior Publication Data

US 2010/0264832 A1 Oct. 21, 2010

(30) Foreign Application Priority Data

Oct. 19, 2007 (GB) ..... 0720488.6

(51) Int. Cl.

| | |
|---|---|
| ***H05B 33/08*** | (2006.01) |
| ***H05B 39/02*** | (2006.01) |
| ***H05B 39/04*** | (2006.01) |
| ***H05B 41/36*** | (2006.01) |
| ***H05B 37/02*** | (2006.01) |

(52) U.S. Cl.

CPC ..... *H05B 33/0866* (2013.01); *H05B 33/0833* (2013.01)

(58) Field of Classification Search

USPC ..... 315/209 R, 219, 224

See application file for complete search history.

(56) References Cited

U.S. PATENT DOCUMENTS

| | | | | |
|---|---|---|---|---|
| 6,040,663 | A * | 3/2000 | Bucks et al. | 315/291 |
| 6,847,169 | B2 * | 1/2005 | Ito et al. | 315/77 |
| 7,242,036 | B1 * | 7/2007 | Nakashima | 257/107 |
| 7,244,036 | B2 * | 7/2007 | Murakami et al. | 362/20 |
| 7,262,559 | B2 * | 8/2007 | Tripathi et al. | 315/291 |
| 7,675,246 | B2 * | 3/2010 | Chiang et al. | 315/291 |

(Continued)

FOREIGN PATENT DOCUMENTS

| | | | |
|---|---|---|---|
| GB | 2398682 | A | 6/2004 |
| GB | 1860922 | A | 11/2007 |

(Continued)

*Primary Examiner* — Dylan White

(74) *Attorney, Agent, or Firm* — Bishop Diehl & Lee, Ltd.

(57) ABSTRACT

A system for controlling solid state lighting including a source to supply any one of a range of AC or DC voltages to a plurality of light strings. The source includes a power factor correction circuit 14 for controlling the power factor to the system and a separate transformer for each light string. The current can pass through each LED string is independently limited by each corresponding LED driver circuit. The current through each LED string can be modified according to a feedback monitor system that measures parameters such as LED characteristics, forward current, temperature, and LED output intensity/color. Each LED string has an independent sensor that monitors the voltage across each switching device in the corresponding LED driver circuits and utilizes a control unit to control the voltages supplied by each corresponding transformer through control signals in response to the monitored switching device voltages.

20 Claims, 3 Drawing Sheets

(56) References Cited

U.S. PATENT DOCUMENTS

| | | | | |
|---|---|---|---|---|
| 7,906,917 | B2 * | 3/2011 | Tripathi et al. | 315/291 |
| 8,044,609 | B2 * | 10/2011 | Liu | 315/291 |
| 8,081,199 | B2 * | 12/2011 | Takata et al. | 345/694 |
| 2005/0218838 | A1 | 10/2005 | Lys | |
| 2006/0001381 | A1 * | 1/2006 | Robinson et al. | 315/185 R |
| 2006/0202637 | A1 | 9/2006 | Chiang et al. | |
| 2007/0114951 | A1 | 5/2007 | Tsen et al. | |
| 2008/0116818 | A1 * | 5/2008 | Shteynberg et al. | 315/192 |
| 2008/0297067 | A1 * | 12/2008 | Wang et al. | 315/294 |
| 2009/0230874 | A1 * | 9/2009 | Zhao et al. | 315/192 |
| 2012/0112649 | A1 * | 5/2012 | Shimura | 315/188 |

FOREIGN PATENT DOCUMENTS

| | | | |
|---|---|---|---|
| GB | 2443091 | A | 4/2008 |
| WO | WO 01/48495 | A | 7/2001 |
| WO | WO 2007/023454 | A | 3/2007 |
| WO | 2007/055519 | A1 | 5/2007 |
| WO | WO 2007055519 | * | 5/2007 |
| WO | WO 2007/096868 | A | 8/2007 |
| WO | WO 2007/134871 | A | 11/2007 |

* cited by examiner

LIGHTING CONTROL SYSTEMS

This invention concerns improvements in or relating to lighting control systems and has particular, but not exclusive, application to power supply circuits for driving LEDs.

To effectively drive LEDs, linear current has to be supplied to the LEDs. Conventionally, this is achieved by providing a fixed voltage power supply with field effect transistors (FETs) limiting the current that can pass through the LEDs to that which is required to drive the LEDs. When the circuit comprises a number of parallel LED strings, the fixed voltage has to be equal to or greater than the voltage that is necessary to achieve the required currents to simultaneously drive all the LEDs. However, a problem with this conventional arrangement is, when only some of the LED strings are activated, only a proportion of the fixed voltage is needed to achieve the required driving currents, with the excess voltage being absorbed by the FET(s) and converted to heat, wasting power. Such circuits can require heatsinks to dissipate the unwanted heat.

To overcome this problem, a switching converter/switching regulator can be used for each LED string to optimise the use of power and for short circuit protection. However, these tend to be expensive and can cause problems if a short circuit occurs.

According to a first aspect of the invention, there is provided a system for controlling solid state lighting comprising:

- a source to supply any one of a range of AC or DC voltages;
- a means for controlling the power factor to the system;
- one or more power transformers each connecting to one or more LED strings;
- a switching means for each string for limiting the currents that can pass through the LED string;
- a sensor monitoring the voltage applied across the switching means;
- feedback means for controlling the power transformer;
- the feedback means varying the voltage supply in response to a monitored voltage across the switching means;
- the feedback means being arranged to cause the power transformers to increase or decrease the voltage according to a predetermined upper and lower voltage level to a particular LED string enabling a means for constant current operation.

By controlling the voltage supplied in response to voltage across the switching means, the voltage supplied can be set at a level just above that required to achieve the current limit through the or each LED string. More specifically, once the current is at the current limit (saturation), as set by the switching means, any increase in voltage supply will increase the voltage drop across the switching means. Changing the voltage supply in response to the voltage drop across the switching means allows one to minimise any excess voltage, reducing power converted to heat, thus improving the efficiency of the lighting control system. In this way, the circuit may be operable without a heatsink. This reduces the cost of the system and allows the system to work over an extended temperature range, as there is less self-heating.

A further advantage is that, by controlling the voltage supplied by the power source in response to the voltage across the switching means, the voltage supplied is varied not only in accordance with activation/deactivation of the LED strings but also in response to changes in the connectors and/or cables connecting the LEDs to the power source.

For example, LED strings (lighting fixtures) may be detachably connectable to the system and the length and resistance of the connectors and/or cables that connect the LED strings to the system could vary depending on the lighting fixture that is connected. Variations in the length and resistance of the cables/connectors may result in a significant change in the voltage drop across the cables/connectors and the system of the invention will automatically compensate for such variations.

It will be understood that the term "LED string" used herein is intended to include a single LED and two or more LEDs connected in series. In one arrangement, the system comprises two or more LED strings connected in parallel.

Power factor is defined herein as the ratio of real power to apparent power. Power factor is a simple way to determine how much of the current contributes to real power in the load. A power factor of one (unity or 1.00) indicates that 100% of the current is contributing to power in the load while a power factor of zero indicates that none of the current contributes to power in the load. Preferably, the power factor of the power supply unit is >0.9, more preferably >0.95, so that, once the power is delivered to the load, the amount of current returned is minimised. This is desirable because:

1. The power transmission lines or power cord will generate heat according to the total current it carries and the resistance of the conductor in the cord resulting in unnecessary power loss
2. Additional cost may be incurred in supply power as power factor correction at the utility supply may have to be provided resulting in additional charges and wasted energy in the supply chain.

A power factor correction (PFC) circuit is preferably employed in the invention to precisely control the input current on an instantaneous basis, to match the waveshape of the input voltage. This mimics a purely resistive load to derive the greatest amount of usable power from the least amount of input line current. The amplitude of the input current waveform is varied over longer time frames to maintain a constant voltage at the converters output filter capacitor.

The PFC circuit not only ensures that no power is reflected back to the source, it also eliminates the high current pulses associated with conventional rectifier filter input circuits.

The switching means may be controlled to activate and deactivate the or each LED string. For example, the switching means may activate the or each LED string by limiting the current to a suitable activation level, for instance 1 mA, and deactivate the or each LED string by limiting the current to a suitable deactivation level, for instance 0 mA. The switching means may be controlled by PWM, PAM, PFM or any other pulse modulation technique. Alternatively, the switching means may be controlled by DC or continuous AC.

The means for controlling the power source may comprise a sensor for monitoring voltages indicative of voltages applied across the switching means and feedback means for causing changes in the voltage supplied by the power source in response to the monitored voltages. Preferably, the feedback means causes the power source to supply a voltage that achieves saturation of the switching means. The feedback means may be arranged to cause the power source to vary the voltage when a saturation point for the switching means changes. The monitored voltages may be the voltages across the switching means. Alternatively, the monitored voltages may be voltages across any number of components including the switching means.

The feedback means may be arranged to cause the power source to increase the voltage if any of the monitored voltages is below a predetermined lower level and to cause the power source to decrease the voltage if all of the monitored voltages are above a predetermined upper level. Such an arrangement is suitable if the components are all of the same type having the same saturation point.

Furthermore, the feedback means may also be arranged to cause the power source to vary the voltage in response to changes in ambient conditions, such as temperature, for the or each LED string. Additionally or alternatively, the feedback means may be arranged to modify how it controls the power source dependent on the colour of the LEDs of the or each LED strings. For example, the feedback means may comprise a temperature sensor, such as a thermistor, and/or a manually operated input to indicate the colour of the LEDs connected. Alternatively, the feedback means may comprise a sensor, for example a photodetector, for automatically detecting the colour of the LEDs.

In a preferred arrangement, the switching means is one or more field effect transistors (FETs), wherein the voltage at a gate of the or each FET limits the current that can pass through the or each LED string. FETs are reliable current control devices that are cheap and easy to incorporate into circuits. Preferably, a FET is provided for the or each LED string. In this way, the current limit for each LED string can be controlled individually.

Alternatively, the switching means may be any other suitable linear current source, for example, the switching means could be a bipolar junction transistor (BJT).

The sensor may comprise any device that can measure the voltage difference between two components in a circuit and may comprise a differentiator/comparator, integrated circuit, passive and/or active components, microprocessors and/or ASICs.

The power source may be an AC to DC power supply, a DC to DC power supply or an AC power supply. Furthermore, the power source may comprise multiple power supply units (PSUs), for example as part of an ASIC.

In some embodiments, the power source employs a power transformer for supplying one or more LED arrays or strings. In preferred embodiments, the power source employs an independent transformer for each string or array of LEDs representing a single LED channel.

According to a second aspect of the invention, there is provided lighting comprising a system according to the first aspect of the invention and one or more LED strings. The lighting may comprise two or more LED strings and, in one arrangement, comprises at least three LED strings, typically a string of LEDs that emit a first colour, for example blue, a string of LEDs that emit a second colour, for example green and a string of LEDs that emit a third colour, for example red. Each LED string may comprise any number of LEDs, however, in typical lighting units there are 36 (12×Red, 12×Green, 12×Blue) or 18 (6×Red, 6×Green, 6×Blue) LEDs. This has particular benefit for colour displays. Alternatively, the lighting comprises one or more white LED strings or LED strings having other colour LEDs, for example orange or amber LEDs.

According to a third aspect of the invention, there is provided a control unit comprising a sensor for monitoring one or more voltages indicative of voltages applied across one or more respective LED strings, a control means responsive to the sensor to output a control signal for controlling the voltage supplied by a power source to the or each LED string, wherein the control means outputs a control signal to increase the voltage supplied by the power source when the or any one of the monitored voltages is below a predetermined lower level and outputs a control signal to decrease the voltage supplied by the power source when the or all of the voltages are above a predetermined upper level.

In one arrangement, the sensor is for monitoring two or more voltages indicative of the voltages applied across one or more of the respective LED strings. The upper and lower predetermined levels may be the same for all monitored voltages or the upper and lower predetermined levels may vary for each monitored voltage depending on the LEDs, FETs, electronic components present in the lighting system being monitored.

According to a fourth aspect of the invention, there is provided a method of controlling lighting comprising one or more LED strings and switching means for limiting the currents that can pass through the or each LED string, the method comprising monitoring the voltage across the switching means and varying voltage supplied to the LED strings in response to voltage across the switching means.

An embodiment of the invention will now be described, by example only, with reference to the accompanying drawings, in which:—

Figure 1:
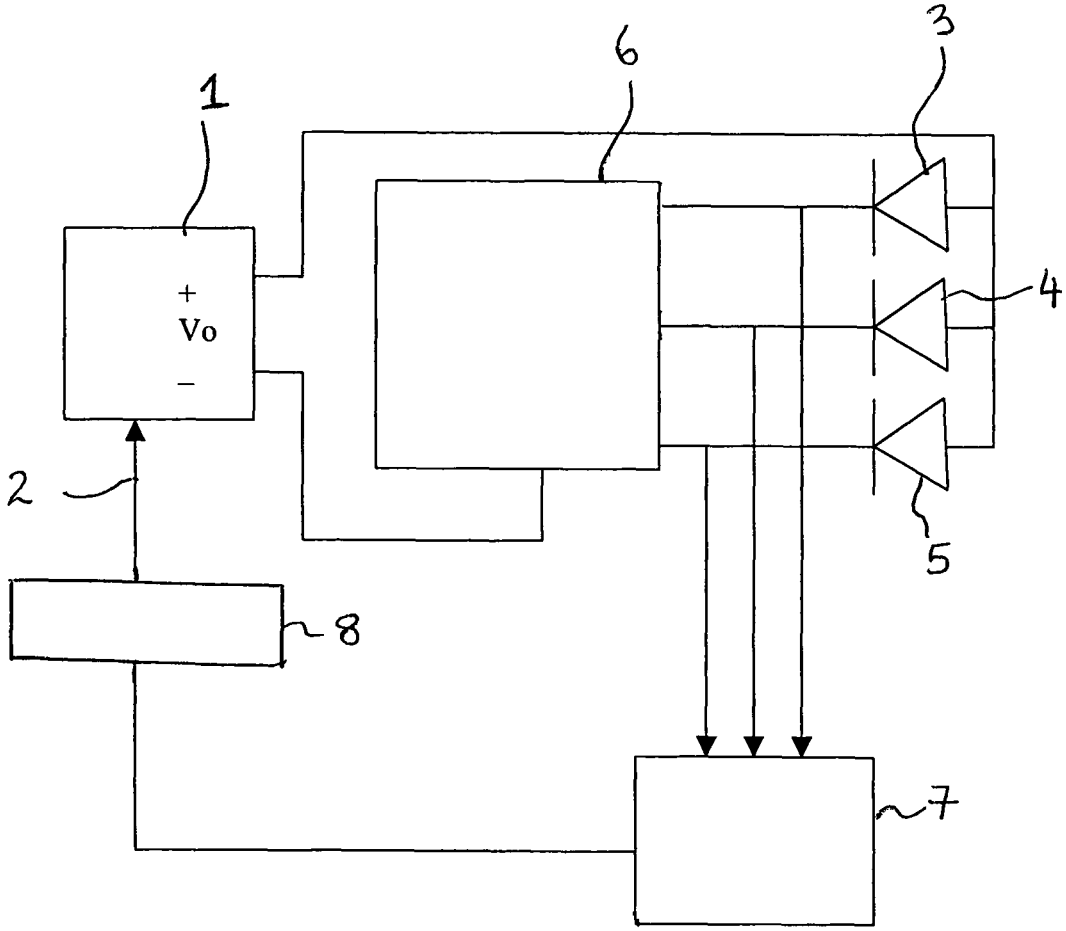
FIG. 1 shows a schematic diagram of a system in accordance with a first embodiment of the invention.
Figure 2:
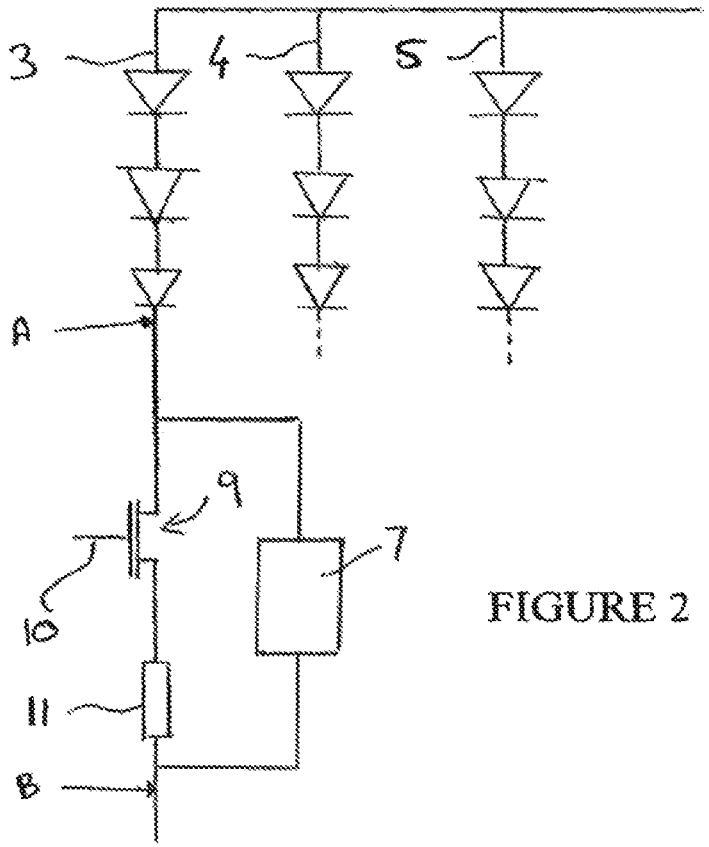
FIG. 2 shows a schematic view of part of the system shown in FIG. 1.

Referring to FIGS. 1 and 2, there is shown a system according to a first embodiment of the invention comprises a power supply unit (PSU) 1 that can supply a voltage at any one of a range of voltages, for example 6V to 42V by any suitable means such as a power transformer (not shown). The PSU 1 varies the voltage supply in response to a control signal 2 and includes a power factor correction circuit (not shown) to increase the power factor of the circuit to >0.9.

The PSU 1 powers a plurality of LED strings 3, 4 and 5. In this embodiment, the LED strings can be detached, for replacement, etc, and consist of a red LED string 3, a green LED string 4 and a blue LED string 5 and typically each LED string consists of 6 or 12 LEDs. The current that can pass through each LED string 3, 4 and 5 is limited by LED driver circuit 6.

FIG. 2 illustrates the LED strings 3, 4 and 5 and a FET 9 and resistor 11 that form part of the LED driver circuit 6. In FIG. 2, only one FET and resistor is shown, however it will be understood that the LED driver circuit 6 comprises a FET and resistor for each LED string 3, 4, 5. The voltage at the gate 10 of each FET 9 is controlled to turn the respective LED strings 3, 4, 5 on and off as required. The FET 9 also acts as a current limiter, limiting the maximum current that can flow through the LEDs dependent upon the magnitude of the control voltage at the gate 10. The control voltage of gate 10 is controlled such that the maximum current that can flow through the LEDs in a string 3, 4, 5 is that required to drive the LEDs to emit a desired intensity of light. The control voltage will depend on the desired light intensity and LED manufacturer's specifications or recommendations.

A sensor 7 monitors voltages across the FET 9 and resistor 11 between points A and B for each LED string 3, 4 and 5 and a control unit 8 controls the voltage supplied by the PSU 1 through control signal 2 in response to the monitored voltages.

In order to achieve maximum efficiency, the system needs to supply just enough voltage such that the FETs reach their saturation point. In this way, the current required to drive the LEDs as desired is achieved while minimising the excess voltage that is dissipated as heat across the FET 9.

Accordingly, in use, the PSU 1 supplies a voltage to the LED strings 3, 4 and 5 under the control of control unit 8. The control unit 8 outputs a control signal 2 to cause the PSU 1 to increase the supplied voltage if any one of the monitored voltages is below a predetermined lower level, in this embodiment 1.5V. In addition, the control unit 8 outputs a control signal 2 to cause the PSU 1 to decrease the supplied voltage if all the monitored voltages are above a predetermined upper level, in this embodiment 2.5V. By controlling the PSU 1 in this way, the voltage supplied is maintained at a level that is just enough to achieve saturation of the FETs 9, ensuring that the required currents are supplied to the LED strings 3, 4 and 5 without an undesirable excess voltage. The range of 1.5-2.5V provides a balance between ensuring that saturation of the FETs 9 is achieved, even if there are small changes in the resistance characteristics of the FETs due to temperature changes, age, etc, and avoiding excess voltages that would lead to unwanted power loss. Furthermore, any current draw when the LED strings are disconnected will be very small, as the PSU will be controlled to supply a very low voltage.

Figure 3:
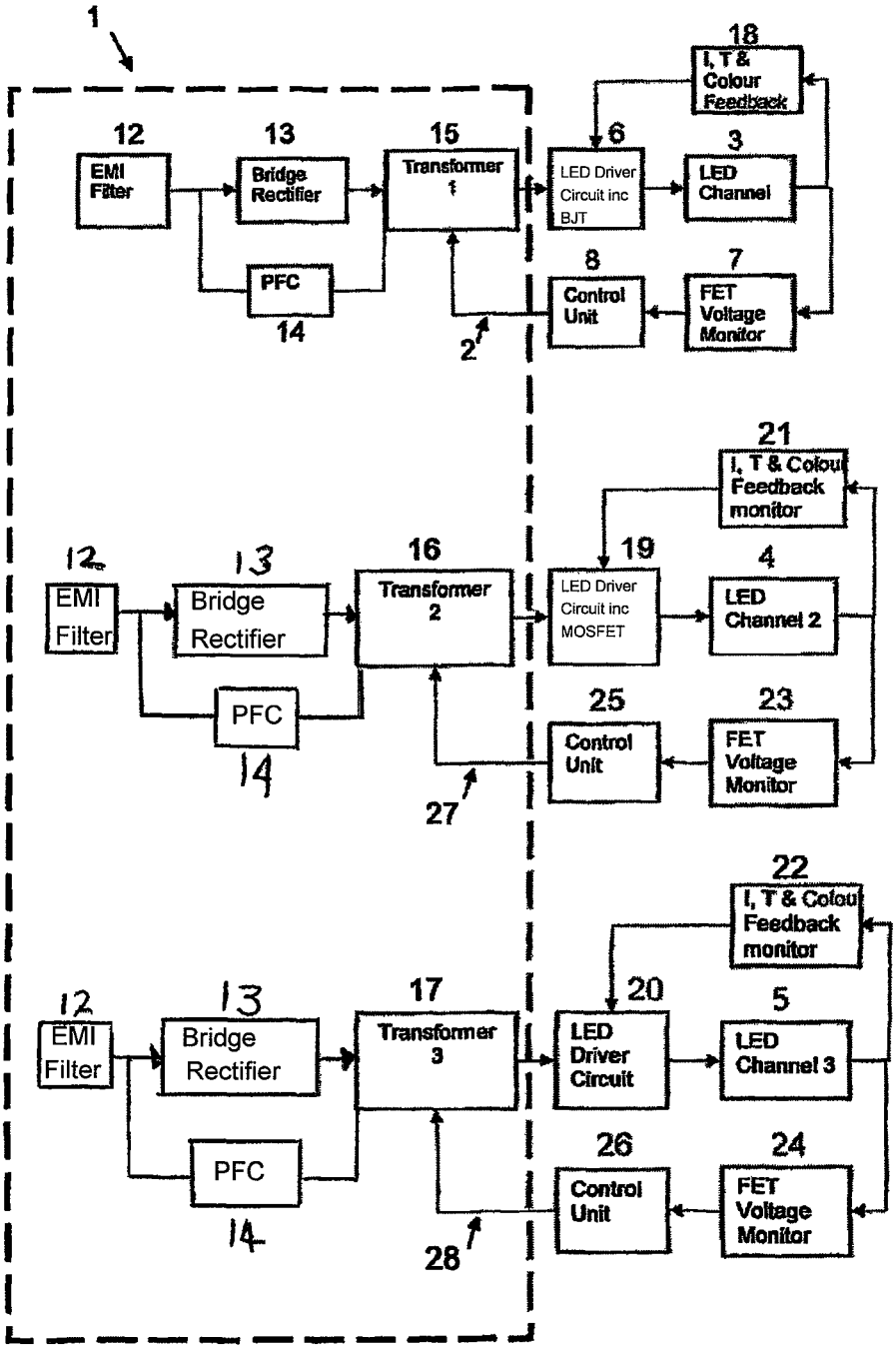
FIG. 3 shows a schematic diagram of another system in accordance with a second embodiment of the invention.

Referring now to FIG. 3, there is shown another system according to a second embodiment of the invention in which like reference numerals are used to indicate parts corresponding to the previous embodiment.

In this second embodiment the PSU 1 includes an electromagnetic interference filter 12 which reduces interference that disturbs, interrupts or degrades the performance of the system; a bridge rectification circuit 13 to rectify the AC power input into a DC power output; a power factor correction circuit 14 to increase the power factor of the circuit to >0.9 and three isolated power transformers 15, 16, 17 to provide isolation between low power and high power circuits and offering voltage conversion from one voltage to another difference voltage to three independent LED driver circuits 6, 19 and 20 controlling three LED strings 3, 4 and 5.

The current that can pass through each LED string 3, 4 and 5 is independently limited by each corresponding LED driver circuit 6, 19 and 20. The current through each LED string 3, 4 and 5 can be modified according to a feedback monitor system 18, 21 and 22 that measures parameters such as LED characteristics, forward current, temperature, and LED output intensity/colour. Each LED string 3, 4 and 5 has an independent sensor 7, 23 and 24 that monitors the voltage across each switching device in the corresponding LED driver circuits 6, 19 and 20 and utilises a control unit 8, 25 and 26 to control the voltages supplied by each corresponding transformer 15, 16 and 17 through control signals 2, 27 and 28 in response to the monitored switching device voltages.

The voltage across the switching means and the corresponding LED channel attached is such that a saturated current is achieved however there is no or little excess voltage supplied increasing the efficiency of the light and control system since less power is converted to heat. This embodiment offers distinct advantages as each LED channel is able to operate independently of each other enabling different numbers of LEDs to be connected within each LED channel. The transformer and monitoring circuitry is able to change the voltage applied to each chain of LEDs independently thus optimizing the voltage whilst reducing any power losses and ensuring high efficiency. The system is also able to optimize the power efficiency in cases where different LED materials or LED forward voltages are used within separate LED channels as the voltage applied to each channel is continuously varied.

In order to ensure the voltage supplied to each LED channel is sufficient to enable a constant current is achieved, the control system for each LED channel can vary the voltage provided by the corresponding transformers by predetermined upper and lower levels or minimum voltage steps. Such upper and lower voltage levels or voltage steps are required as the voltage required by each LED channel will vary according to the forward current applied to each LED channel. For example, the forward voltage of a typical blue or green LED can vary by more than 20% when driven by a high forward current as compared to a low forward current. Thus, if an LED channel contains, say, 12 LEDs the increase in voltage required to maintain a constant current drive is significant when the LED channel is set to a maximum current. Therefore, a predetermined upper and lower voltage level is required to ensure the system is responsive to rapid changes in current and also sensitive to smaller changes in current due to thermal changes for example ensuring any changes in the light output of the LED channel is smooth and without intensity flicker.

It will be understood that various modifications and alterations can be made to the described embodiment without departing from the scope of invention described herein. In particular, the range of voltages that can be supplied by the power supply unit is not limited to that described above but other voltage ranges may be appropriate for other arrangements of LEDs, etc. In general, the power supply unit needs to be able to supply a range of voltages, wherein the lowest voltage is the sum of the forward voltage required to drive one LED string, and the associated FET/transistor and the voltage drop across the resistor 11 and the highest is the sum of the forward voltage required to drive the maximum number of LED strings that can be activated at any one time and the associated FETs/transistors, the voltage drop across the resistors 11 and any voltage drop caused by components connecting the lighting unit to the PSU, e.g. cables.

The voltages chosen for the predetermined upper and lower levels may be varied depending upon the components used, set-up of the circuit and acceptable tolerances and power losses. The number of LED strings and the number of LEDs in each string may be varied; in particular, there may be one or more LED strings and one or more LEDs in each string.

Furthermore, the system could be provided as an integrated unit, as a system that is detachably connectable to LED lighting or as a control unit to be retro-fitted to exiting lighting systems. The control unit 8 may comprise hardwired logic circuits or a microcontroller programmed with appropriate software to achieve the functionality required for the invention.

According to another aspect, the present invention provides' a system for controlling solid state lighting comprising a source to supply any one of a range of AC or DC voltages to a plurality of light strings, the source including a separate transformer for each light string wherein the current that can pass through each LED string is independently limited by a corresponding LED driver circuit and can be modified according to a feedback monitor system that measures a parameter, each LED string has an independent sensor that monitors the voltage across each switching device in the corresponding LED driver circuit and utilises a control unit to control the voltages supplied by the corresponding transformer in response to the monitored switching device voltages.

According to a still further aspect, the present invention provides a system for controlling solid state lighting comprising a power source controllable to supply any one of a range of voltages, a connection for connecting one or more LED strings to the power source, switching means for limiting the currents that can pass through the or each LED string and means for controlling the power source to vary the voltage supplied in response to voltage across the switching means.

The invention claimed is:

1. A system for controlling solid state lighting comprising:

a power source to supply any one of a range of AC or DC voltages;

a means for controlling a power factor to the system;

one or more power transformers each connecting to one or more LED strings;

a switching means for each string for limiting the currents that can pass through the LED string;

a sensor, parallel to the switching means, monitoring only the voltage applied across the switching means;

feedback means for controlling the power transformer;

the feedback means varying the voltage supply in response to only the voltage monitored by the sensor across the switching means;

the feedback means being arranged to cause the power transformers to increase or decrease the voltage according to a predetermined upper and lower voltage level to a particular LED string to correctly regulate the current through the LED string for constant current operation, and wherein the feedback means is arranged to modify how it controls the power source dependent on intensity of the LED string.

2. The system according to claim 1 comprising two or more LED strings.

3. The system according to claim 1, wherein the switching means may be controlled to activate and deactivate the or each LED string.

4. The system according to claim 3, wherein the switching means activates the or each LED string by limiting the current to a suitable activation level and deactivates the or each LED string by limiting the current to a suitable deactivation level.

5. The system according to claim 3, wherein the switching means is controlled by PWM, PAM, PFM or any other pulse modulation technique.

6. The system according to claim 3, wherein the switching means is controlled by DC or continuous AC.

7. The system according to claim 1, wherein the feedback means is arranged to cause the power source to supply a voltage that achieves saturation of the switching means.

8. The system according to claim 7, wherein the feedback means is arranged to cause the power source to vary the voltage when a saturation point for the switching means changes.

9. The system according to claim 1, wherein the feedback means is arranged to cause the power source to vary the voltage in response to changes in ambient conditions for the or each LED string.

10. The system according to claim 1, wherein the switching means is one or more field effect transistors (FETs), wherein the voltage at a gate of the or each FET limits the current that can pass through the or each LED string.

11. The system according to claim 10, wherein a FET is provided for the or each LED string.

12. The system according to claim 1, wherein the switching means is a bipolar junction transistor (BJT).

13. The system according to claim 1, wherein the sensor comprises any device that can measure the voltage difference between two components in a circuit.

14. The system according to claim 1, wherein the power source is an AC to DC power supply, a DC to DC power supply or an AC power supply.

15. The system according to claim 1, wherein the power source comprises multiple power supply units (PSUs).

16. The system according to claim 1 comprising at least three LED strings comprising a string of LEDs that emit a first colour, a string of LEDs that emit a second colour and a string of LEDs that emit a third colour.

17. The system according to claim 16, wherein each LED string is detachably connectable to the system.

18. The system according to claim 1, further comprising a control unit comprising a control means responsive to the sensor to output a control signal for controlling the voltage supplied by a power source to the or each LED string, wherein the control means outputs a control signal to increase the voltage supplied by the power source when the or any one of the monitored voltages is below a predetermined lower level and outputs a control signal to decrease the voltage supplied by the power source when the or all of the voltages are above a predetermined upper level.

19. A method of controlling lighting comprising one or more LED strings and switching means for limiting the currents that can pass through the or each LED string, the method comprising providing a power source to supply any one of a range of AC or DC voltages, providing a means for controlling power factor, providing one or more transformers each connecting to one or more LED strings, providing a sensor, parallel to the switching means, monitoring only the voltage applied across the switching means and varying voltage supplied to the LED strings in response to only the voltage monitored by the sensor across the switching means.

20. The system according to claim 1, wherein the one or more power transformers comprises:

a first power transformer connecting to one or more first LED strings; and a second power transformer connecting to one or more second LED strings;

wherein the feedback means comprises:

a first control unit connecting to the first power transformer, the first control unit being arranged to cause the first power transformer to increase or decrease a voltage to the one or more first LED strings; and a second control unit connecting to the second power transformer, the second control unit being arranged to cause the second power transformer to increase or decrease a voltage to the one or more second LED strings.

* * * * *

UNITED STATES PATENT AND TRADEMARK OFFICE

CERTIFICATE OF CORRECTION

PATENT NO. : 9,232,603 B2
APPLICATION NO. : 12/738750
DATED : January 5, 2016
INVENTOR(S) : Geoffrey Howard Gillet Archenhold and Keith Anderson It is certified that error appears in the above-identified patent and that said Letters Patent is hereby corrected as shown below:

On the Title Page:

- The ASSIGNEE listed should be deleted: "Landy Vent UK Limited at Studley, Warwickshire, Great Britain" and replaced with: Radiant Research Limited of Aldridge, West Midlands, United Kingdom.

Signed and Sealed this
Fifth Day of July, 2016

Michelle K. Lee

Michelle K. Lee
*Director of the United States Patent and Trademark Office*